United States Patent [19]

Woods et al.

[11] Patent Number: 4,625,636

[45] **Date of Patent: * Dec. 2, 1986**

[54] VEHICLE COMPACTOR

[75] Inventors: Richard E. Woods; Marvin D. Bradburn, both of Markle, Ind.

[73] Assignee: Car-Go, Corp., Muncie, Ind.

[ * ] Notice: The portion of the term of this patent subsequent to Apr. 16, 2002 has been disclaimed.

[21] Appl. No.: 716,448

[22] Filed: Mar. 27, 1985

Related U.S. Application Data

[60] Continuation-in-part of Ser. No. 534,805, Sep. 22, 1983, Pat. No. 4,510,858, which is a division of Ser. No. 347,489, Feb. 10, 1982, Pat. No. 4,426,928.

[51] Int. Cl.[4] ..... B30B 9/32

[52] U.S. Cl. ..... 100/35; 100/45; 100/215; 100/233; 254/334

[58] Field of Search ..... 100/35, 45, 215, 233, 100/901, 271, 272, 295, 43, 100; 254/334

[56] References Cited

U.S. PATENT DOCUMENTS

| | | | |
|---|---|---|---|
| 3,266,413 | 8/1966 | Sharp | 100/901 X |
| 3,273,493 | 9/1966 | Smiltneek | 100/901 X |
| 3,356,018 | 12/1967 | Swint et al. | 100/901 X |
| 3,413,914 | 12/1968 | Ballard | 100/901 X |
| 3,545,369 | 12/1970 | Tokushima | 100/901 X |
| 3,651,754 | 3/1972 | Forest | 100/901 X |
| 3,730,078 | 5/1973 | Flanagan | 100/901 X |
| 3,752,064 | 8/1973 | Suzuki | 100/901 X |
| 3,762,321 | 10/1973 | Patros | 100/901 X |
| 3,796,151 | 3/1974 | Williams | 100/901 X |
| 3,965,812 | 6/1976 | Oberg | 100/901 X |
| 4,188,876 | 2/1980 | Graves | 100/901 X |
| 4,369,700 | 1/1983 | Flagg | 100/233 X |

FOREIGN PATENT DOCUMENTS

| | | |
|---|---|---|
| 947519 | 4/1960 | United Kingdom . |
| 1127391 | 9/1968 | United Kingdom . |
| 1147401 | 4/1969 | United Kingdom . |
| 1177976 | 1/1970 | United Kingdom . |
| 1220844 | 1/1971 | United Kingdom . |
| 1500097 | 2/1978 | United Kingdom . |

*Primary Examiner*—Billy J. Wilhite

*Attorney, Agent, or Firm*—Jenner & Block

[57] ABSTRACT

A compactor particularly for junk vehicles, has a flatbed supporting a pair of opposed, hinged compaction doors. Each door has a linkage hydraulically operated to open and close the door for compaction of the vehicle against the flatbed. A winch disposed on the front of the compactor has its tow line extending beneath the doors and connects to the front or rear end of the vehicle to progressively advance the vehicle over the flatbed for compaction by the doors. A sequence control circuit is also provided which automatically opens and closes the compactor doors and automatically operates the winch to sequentially advance segments of the vehicle into the compactor. Additionally, the compactor can easily be made portable facilitating its transportation from one location to another.

15 Claims, 21 Drawing Figures

Fig. 1.
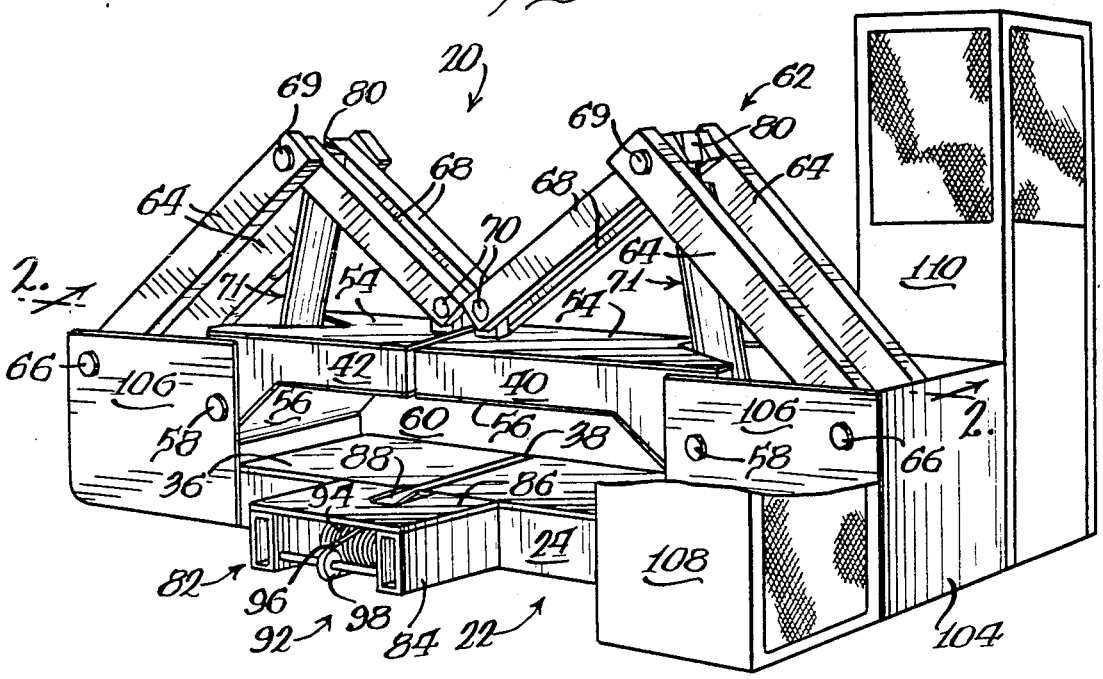
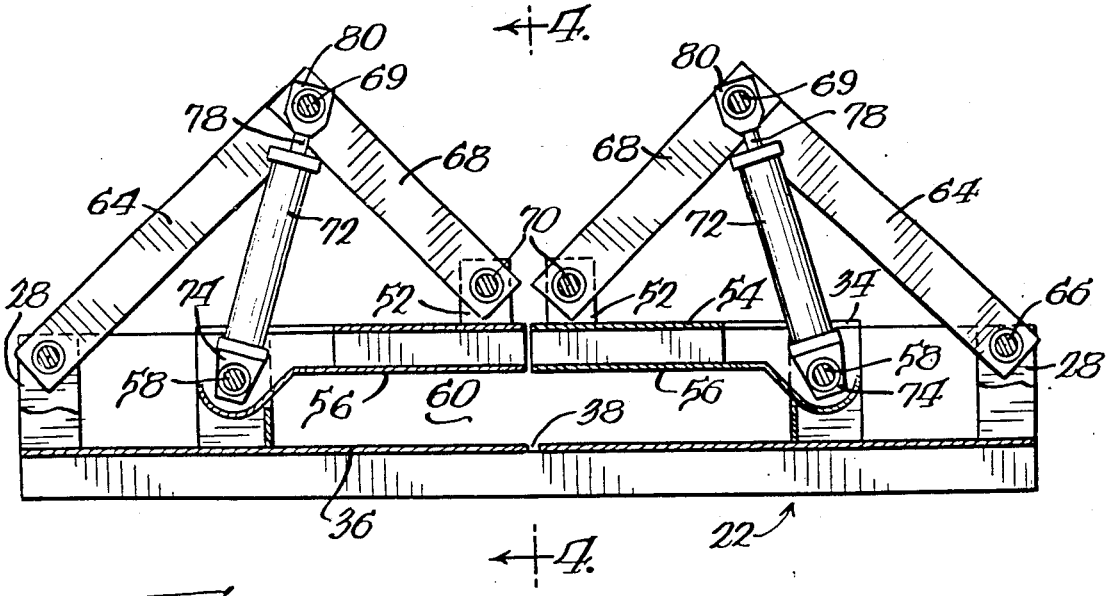
Fig. 2.

Fig. 9.
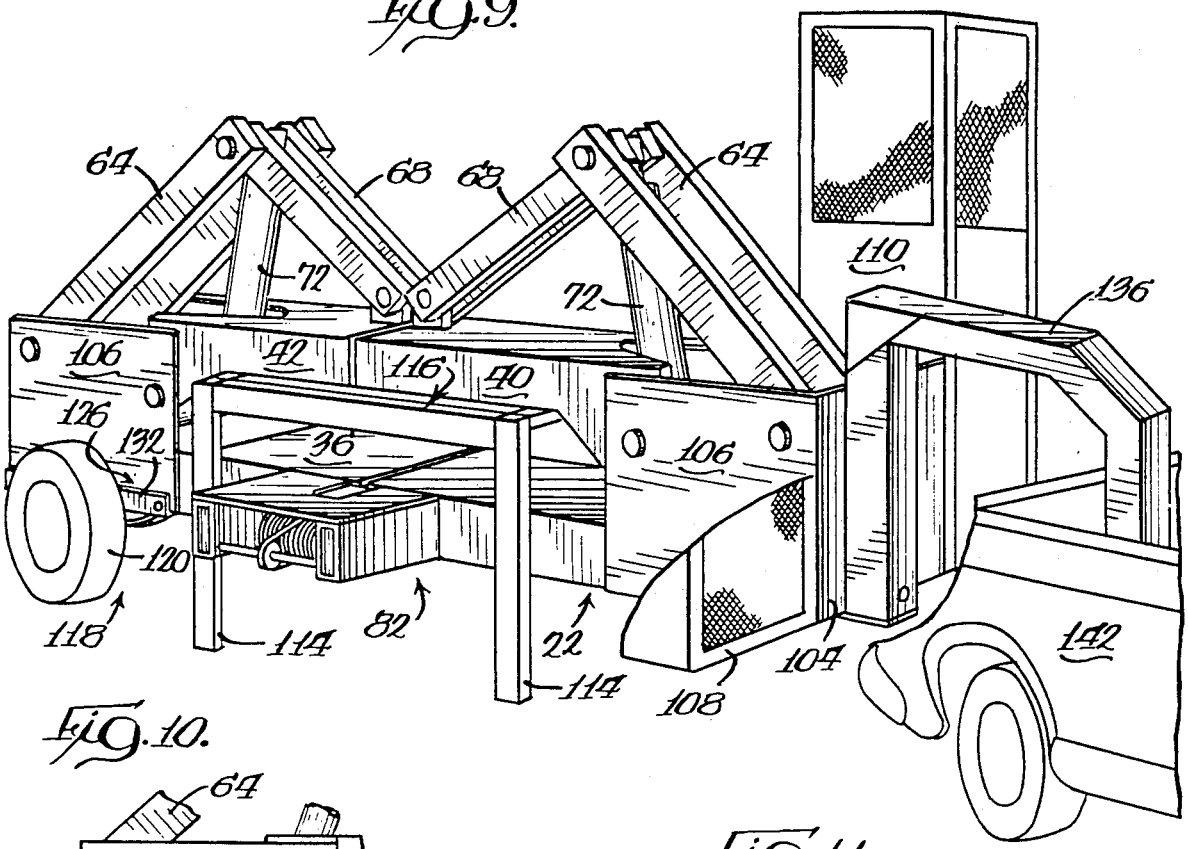
Fig. 10.
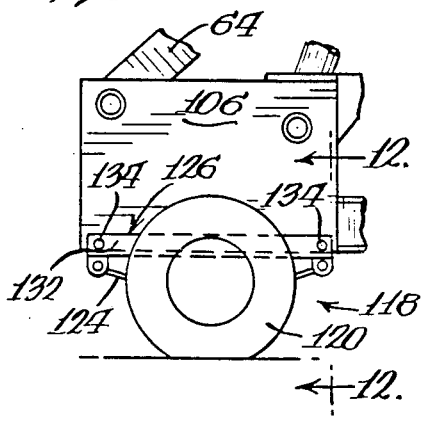
Fig. 11.
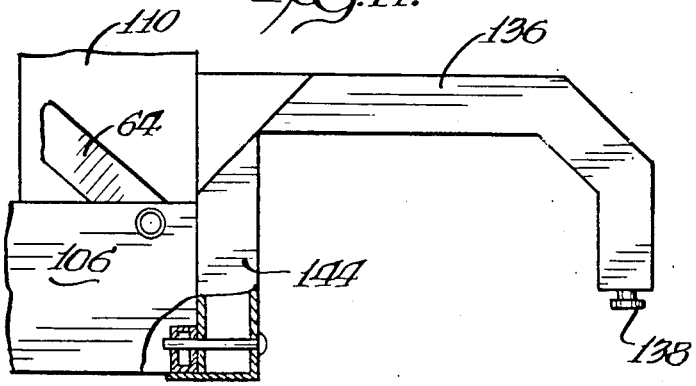
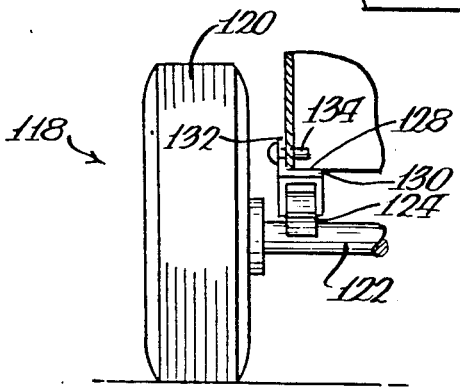
Fig. 12.

276
290
316
354
278
LATCH RELAY D
358
WINCH ADV. SOLENOID
314
WINCH REV. SOLENOID
320
364
F
362
E
366
E
D
356
368
370
372
374
RELAY F
375
376
F
TDR E
360
G
280
E
363
TDR H
380
G
378
382

VEHICLE COMPACTOR

BACKGROUND OF THE INVENTION

1. Related Applications

This application is a Continuation-In-Part of application Ser. No. 534,805, filed 9-22-83, entitled "Vehicle Compactor" now U.S. Pat. No. 4,510,858, which is a Divisional of application Ser. No. 347,489, filed 2-10-82, entitled "Vehicle Compactor" which has now been issued as U.S. Pat. No. 4,426,928.

2. Field of the Invention

This invention relates to junk metal compactors and in particular to those designed for the compaction of vehicles.

3. Description of the Prior Art

One type of compactor for vehicles has a flat frame supporting a plurality of upstanding members. Several of the upstanding members support a pair of opposed doors which pivot toward and, when closed, parallel the frame to sequentially crush segments of the vehicle as it is advanced through the compactor. To manipulate each door a two-part linkage, connected by an elbow pin, has one of its ends secured to the door. The other end of the linkage is pivotally mounted by several other upstanding members, the pivot axis being supported substantially above the frame and above the pivot axis for the corresponding door. Each door is raised and lowered by a hydraulic cylinder having one end supported by still other upstanding members, the other end of the cylinder connected to the linkage elbow pin. Accordingly, actuating the hydraulic cylinders manipulates the linkages to, in turn, drive the doors for opening and closing.

One drawback of the type of compactor described above is that the linkages are supported at the ends of the upstanding members which are relatively distant to the frame. Accordingly the upstanding members must be large or additional supporting means are required to prevent these members from deforming under the forces imposed upon the linkage during compaction. This adds not only additional weight but also cost to the device.

Another drawback is that the doors, linkages and hydraulic cylinders all require independent, pivotal supports. Again, this increases the weight and cost of the device.

Another problem with prior compactors, including the type described above, relates to the means by which the vehicle is advanced through the device. Typically a winch line, supported in front of the device by a pulley secured to a stake in the ground, is attached to the front of the vehicle to pull it through the device for compaction. The disposition of the pulley in front of the device enables the entire vehicle to be pulled therethrough. However, during advancement of the vehicle, the compactor tends to walk toward the stake. Eventually the space between the stake and device becomes such that one or the other must be repositioned. Accordingly, constant supervision is required and time is wasted during repositioning.

Still another drawback found in the compactors of the prior art, is that manual operation is required to repeatedly compact a segment of the vehicle and advance a new segment into the device for compaction. Manual operation is time consuming and costly.

Yet still another drawback is that many prior art compactors are not easily portable from one location to another. Often the weight of a compactor necessitates the use of a large flatbed trailer. In turn, apparatus must be provided to lift the compactor onto the trailer. These are contributing factors to the cost of compactor operation.

SUMMARY OF THE INVENTION

The present invention is directed towards overcoming one or more of the drawbacks and problems noted above.

Accordingly, the vehicle compactor of the present invention has a pair of opposing, pivotal doors. The doors are manipulated by medially pivoted linkages supported above a flatbed frame by upstanding supports. The door and linkage pivots are supported relatively close to the flatbed frame and substantially equidistant therefrom. Due to the proximity of the door and linkage pivots to the flatbed, the supports therefor and the remainder of the frame may be constructed from tubular steel to conserve weight and reduce cost.

Drive means, interconnected between the pivots for the doors and the medial pivots of the linkages, drive the linkages to open and close the doors. The substantially equidistant disposition of the door and linkage pivots from the flatbed results, it is believed, in a more efficient use of the drive means. Additionally the common use of the door pivot by the door and the drive means dispenses with the need for independent supports therefor and is also believed to further contribute to the efficient use of the drive means.

Supported on the front of the vehicle compactor is a winch mechanism. The line from the winch passes over the flatbed and is secured to the end of the vehicle most distant from the compactor. Operation of the winch pulls the entire vehicle from its front or rear, i.e., in effect pulls or pushes the vehicle, through the compactor for complete compaction. This substantially eliminates the forces which otherwise result in compactor "walk."

The operation of the winch mechanism to advance segments of the vehicle through the device and the opening and closing the doors for compaction can be either manual or automatically controlled. Under automatic control each step of advancement, closing of the doors for compaction, opening of the doors, and repeated advancement follows a timed sequence. At such time as the last segment enters the device, a sensor signals the sequence control whereby the device completes compaction of the remaining segment and stops. This obviates many of the steps required for manually controlled compaction.

To transport the compactor of this invention, the compactor is lifted off the ground and wheels are interposed therebetween. According to the present invention, the hydraulic forces used to close the doors are employed to elevate the compactor. This eliminates entirely the need for a separate trailer to transport the compactor, and eliminates the need for a crane or other separate hoisting device.

One object of the present invention is a lighter weight and lower profile compactor with equal or greater compaction forces and greater versatility in operation and transportation.

It is another object of the present invention to set forth a compactor wherein the drive means for the doors is interconnected between the pivots for the doors and the medial pivots for the door linkages. This dispenses with the need for independent supports therefor and, it is believed, contributes to the efficient use of the drive means.

Still a further object of the present invention is to set forth a vehicle compactor having a frontally located winch mechanism which is entirely and integrally connected to the frame of the compactor. A line from the winch pulls the vehicle from the front or rear through the compactor. This eliminates the forces which otherwise result in compactor walk.

Yet a further object of the present invention is to set forth a compactor which can be both manually or automatically operated and the automatic controls which improve the efficiency of the overall compacting operation.

A further object of the present invention is to set forth a compactor which can, quickly and easily, be made portable, and which eliminates the necessity for separate trailers and hoist mechanisms.

While an illustrative embodiment of the invention is shown in the drawings and will be described in detail herein, the invention is susceptible of embodiment in many different forms and it should be understood that the present disclosure is to be considered as an exemplification of the principles of the invention and is not intended to limit the invention to the embodiment illustrated. The scope of the invention will be pointed out in the appended claims.

BRIEF DESCRIPTION OF THE DRAWING

FIG. 1 is a perspective view of the front of the car compactor with the doors in the closed position;

FIG. 2 is a sectional view of the car compactor taken along line 2—2 of FIG. 1;

FIG. 9 is a perspective view of the compactor ready for transport;

FIG. 10 is a side view of a portion of the compactor illustrating the attachment of the wheel carriage for transport;

FIG. 11 is a partially broken away side view of a portion of the compactor showing the attachment of the transporting yoke;

FIG. 12 is a section view of the compactor taken along line 12—12 of FIG. 10;

OVERALL SYSTEM

Figure 3:
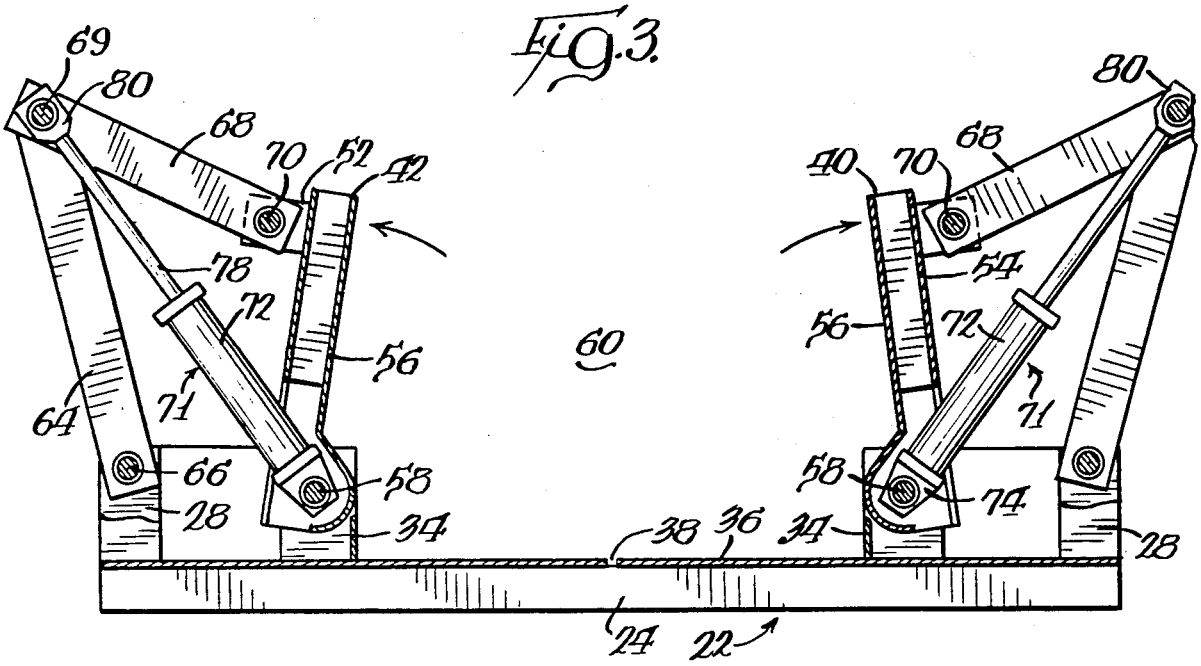
FIG. 3 is the same view as FIG. 2 illustrating the doors in the opened position.

Viewing FIGS. 1 and 2, a compactor 20 is seen to include a pair of opposing right and left compaction doors 40 and 42, respectively, pivotally supported above a flatbed 22. The doors are manipulated for opening and closing for the compaction of segments of a vehicle by two-part linkages 62, each of which has one end connected to the door and the other end supported above the flatbed 22 at a location outboard of and substantially equidistant above the flatbed 22 with the pivot axis of the doors. Drive means, such as a hydraulic cylinder 71, are interposed between the door pivot and an elbow pin 69, which pivotally connects two parts of the linkage 62, to drive each linkage 62 and thereby manipulate the corresponding door. The hydraulic cylinders 71 may, as set forth in detail below, be either manually or automatically controlled to open and close the doors.

To advance the vehicle for compaction, a winch mechanism 92 disposed frontally on the flatbed 22 has winch line 96 which passes over the flatbed 22 for connection to the front or rear portion of the vehicle. Manually or automatically driving of the winch mechanism 92 pulls a segment of the vehicle onto the flatbed 22 whereupon the right and left doors 40 and 42 are manipulated to close and compact the segment of the vehicle against the flatbed 22. Thereafter the doors are opened and the winch mechanism 92 is activated to advance another segment of the vehicle onto the flatbed 22 for compaction. This crushing operation is repeated until all segments of the vehicle have been compacted.

Figures 5, 6, 15A, 15B, 15C, 15D:
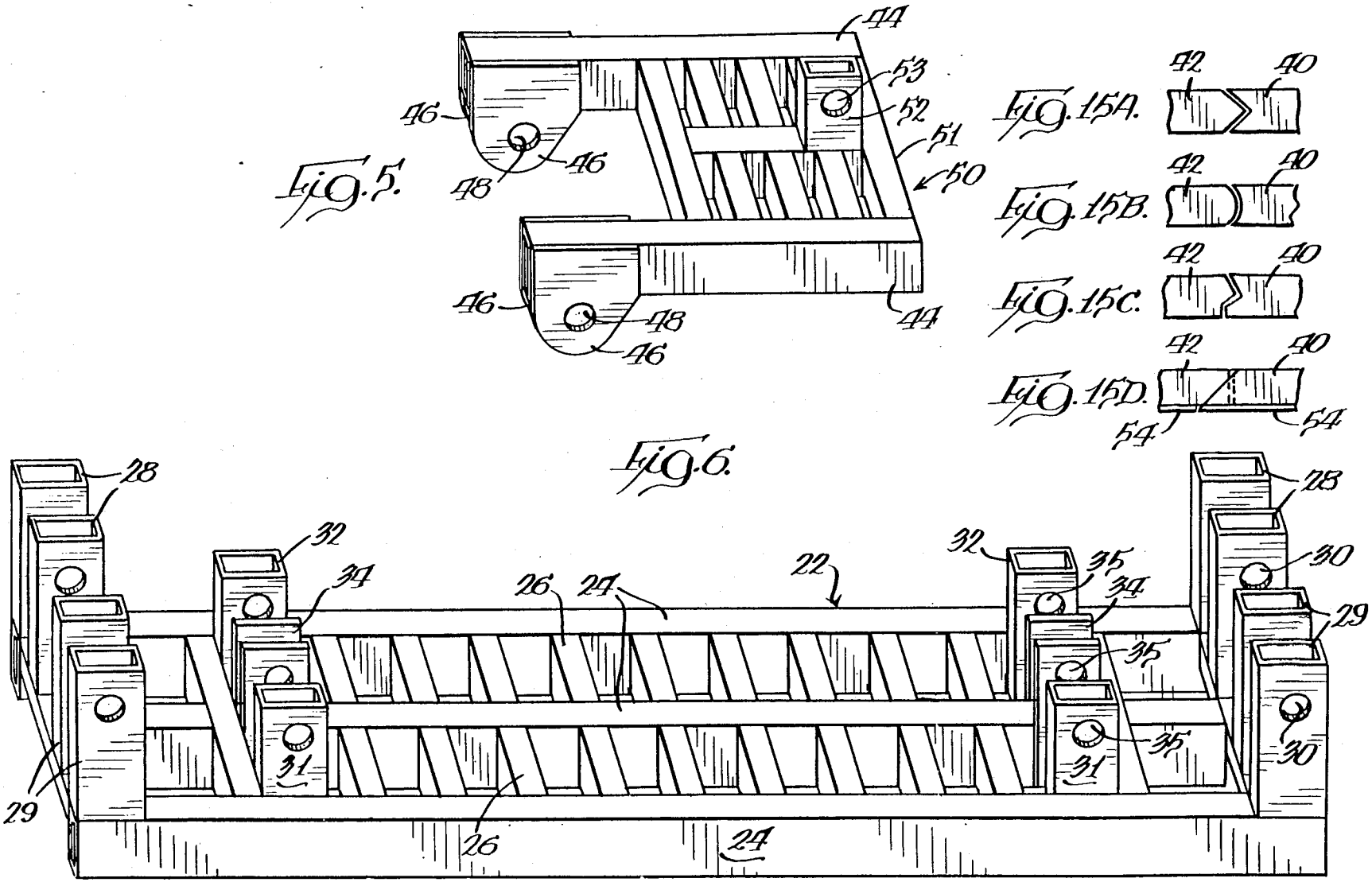
FIG. 5 is a perspective view of the frame of a door.
FIG. 6 is a perspective view of the frame and supports of the flatbed.
FIGS. 15A through 15D are side views of various embodiments of the compactor doors illustrating the interlocking or overlapping thereof.

To provide the necessary overall structure or support to the compactor 20 to enable it to accomplish the foregoing, the compactor 20 has a unitary flatbed 22, the frame of which, as shown in FIG. 6, consists of joists 24 spaced apart by a plurality of ribs 26. It is particularly advantageous from a weight and cost standpoint to use tubular or hollow joists and ribs.

To support the linkages 62, upstanding from each outboard end of the flatbed 22 are two pairs of relatively short forward and rear linkage supports 28 and 29, respectively, which are appropriately secured to the flatbed 22. Disposed inboard of the forward and rear linkage supports 28 and 29 to support the doors and hydraulic cylinder 71 is a pair of forward and rear door supports 31 and 32 having disposed therebetween a bifurcated cylinder support 34. Due to the shortness of the upstanding supports, they may be made of tubular design, conserving weight and reducing cost.

A smooth top surface over which the vehicle is advanced to be crushed is formed by a plate 36 having a central groove 38, secured over the framed flatbed 22, as shown in FIGS. 1 and 2.

Supported by each set of forward and rear door supports 31 and 32 are the right and left vehicle compacting doors 40 and 42. Each door, as shown in FIG. 5, has a pair of elongated door joists 44 having at the ends of which a pair of pivot supports 46. Spanning the door joists 44, inward of the pivot supports 46, is a door framework 50 which provides strength to the door and supports an upstanding linkage connection 52. As with the flatbed 22, the above described framework 50 and joists 44 as well as the linkage connection 52 are of tubular steel. Secured to the top of the doors 40 and 42 as seen in FIGS. 1 and 2, is a door cover plate 54 to prevent the accumulation of debris therein.

To the underside of the doors 40 and 42 is attached a compaction plate 56 which also spans the pivot supports 46. The compaction plate 56, as the doors close, compacts the vehicle against the flatbed plate 36. The forwardmost joist of the door may be rectangular so as to define a planar door end 51, or the corresponding ends 51 of the respective doors may be interlocking as shown in FIGS. 15A–C. Alternatively, the compaction plate 56 of one door may be extending as depicted in FIG. 15D to provide for the overlapping of the doors. The interlocking or overlapping structure enables the closing forces of the doors to be added to one another to completely compact even the most troublesome of vehicle structures.

Figures 15E, 16:
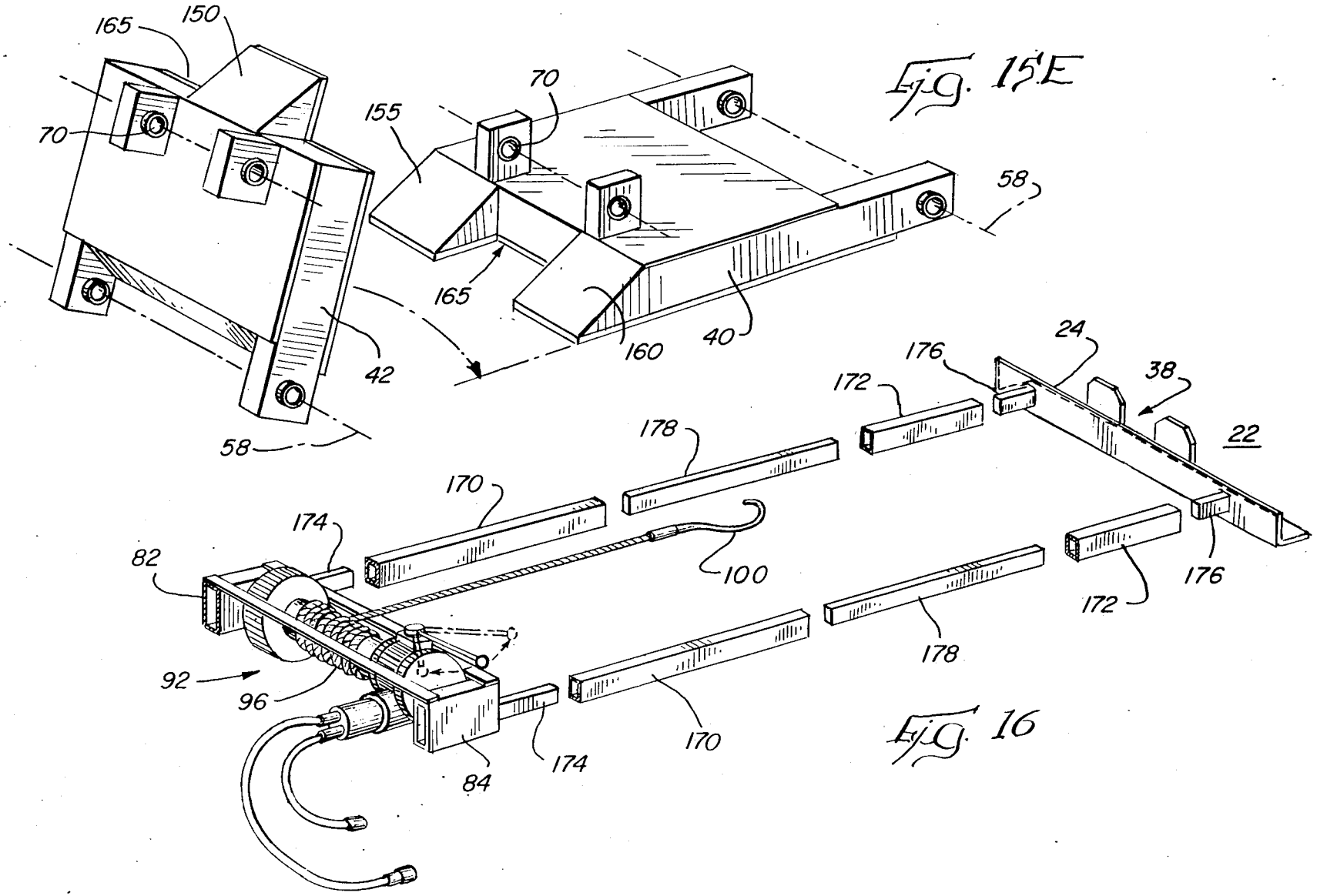
FIG. 15E is a perspective view of a portion of the compactor illustrating the interlacing doors; and, FIG. 16 is a perspective view of a portion of the compactor illustrating the winch housing secured and spaced from the flatbed.

A preferred embodiment of the doors 40 and 42 is illustrated in FIG. 15E. The end of the door 42 opposite the pivot mounting 58 has at least one protruding finger 150. The end opposite the pivot mounting 58 of the other door 40 has corresponding protruding fingers 155 and 160 which are formed to mate with the first protruding finger 150. This embodiment allows the doors 40 and 42 to interlace without pinching the vehicle being crushed. The doors 40 and 42 may be closed simultaneously or in sequence. Preferably, the protruding fingers 150, 155, and 160 extend beyond the centerline of the compacting area of the bed as marked by edges 165 of doors 40 and 42. Thus, the protruding fingers 150, 155, and 160 would extend beyond the crushing high point on the vehicle.

To pivotally secure the right and left doors 40 and 42 to the compactor 20, the doors and cylinder supports have, at their upstanding ends, coaxially aligned door receiving bores 35. Each door has, in a like manner, coaxially aligned pivot bores 48 disposed in the pivot supports 46 so as to be located underneath the door. The disposition of the pivot bores 48 beneath the underside of the door is particularly advantageous to increase and offset the radius of the arc defined by the door as it opens and closes toward the flatbed 22. Accordingly, the doors will approach the vehicle to be compacted in a flatter, outside-to-inside manner than would a door whose pivot is aligned with the door itself. The result is that objects on the vehicle such as door frames, disc brake rotors and the like are first folded over before the door exerts downward compaction. This enables the vehicle to be more efficiently compacted. Positioning the doors and passing a door pin 58 through the pivot bores 48 and the door securing bores 35 at the upstanding end pivotally secures each door to the front and rear door support 31 and 32 and more particularly to the flatbed 22. It follows that, as shown in FIGS. 2 and 3, the right and left doors 40 and 42 are free to pivot toward and away from the flatbed 22 along the relatively flat arc discussed above.

To manipulate the right and left doors 40 and 42 for opening and the compacting closure thereof, the linkage 62 is interconnected between each door's linkage connection 52 and the associated linkage supports 28 and 29. Each linkage 62 has a pair of rear arms 64 which are pivotally secured to the linkage supports 28 and 29 by the passage of a link pin 66 through bores at the end of the rear arm 64 and coaxially aligned link receiving bores 30 at the upstanding ends of the pairs of the link supports 28 and 29. As best seen in FIGS. 1 and 2, a pair of forward arms 68 have their ends pivotally secured to the ends of the rear arms 64 by an elbow pin 69 and the other ends attached to the linkage connection 52 by an end pin 70 passing mutually therethrough. From the foregoing and viewing FIGS. 2 and 3, it can be seen that the linkage 62 can be manipulated via the elbow pin 69 to open and close the right and left doors 40 and 42.

Each linkage 62 is manipulated by a hydraulic cylinder 71 interconnected between the door pin 58 and the elbow pin 69. This disposition of the hydraulic cylinder 71 is advantageous in that it does away with separate pivotal supporting means by using the door pin 58 as the pivot. Additionally, it is believed that this orientation increases the efficiency at which the forces generated by the hydraulic cylinder 71 are used. The hydraulic cylinder 71 includes a cylinder portion 72 having a cylinder clevis 74. The door pin passes through the cylinder supports 34 and the cylinder clevis 74 to pivotally secure the cylinder portion 72 and the remainder of the hydraulic cylinder 71 to the flatbed 22. Disposed within the cylinder portion 72 is a hydraulic piston (not shown in FIGS. 1 and 2) having a rod 78 at the end of which is similarly disposed a piston clevis 80. The piston clevis 80 is pivotally secured to the linkage 62 by its disposition between the forward and rear arms 68 and 64 and by the passage of the elbow pin 69 therethrough.

The operation of the compactor 20 to open and close the right and left doors 40 and 42 will now be set forth. Viewing FIG. 3, the doors are shown in the open position in readiness to compacting a segment of a vehicle. The piston and its rod 78 of the hydraulic cylinder 71 are extended by the introduction of hydraulic fluid, which may be manually or automatically controlled, as described in detail below. In turn, through the elbow pins 69 and forward arms 68, this induces an opening moment on the right and left doors 40 and 42. This moment opens and maintains the doors in the opened position. To close the doors the piston 76 of the hydraulic cylinder 71 is driven inward (downward as shown in FIG. 2) which in turn results through the elbow pin 69 and forward arms 68 in a moment upon the doors 40 and 42, closing them to compact any object between their respective compaction plates 56 and the plate 36.

The disposition of each hydraulic cylinder 71 between the door pin 58 and elbow pin 69 is believed to enhance the efficient use of the compaction forces generated by the hydraulic cylinder 71. Additionally, it is believed that the connection of the linkages 62 relatively close to the flatbed 22 also increases the efficiency at which the compaction force is used.

Figure 4:
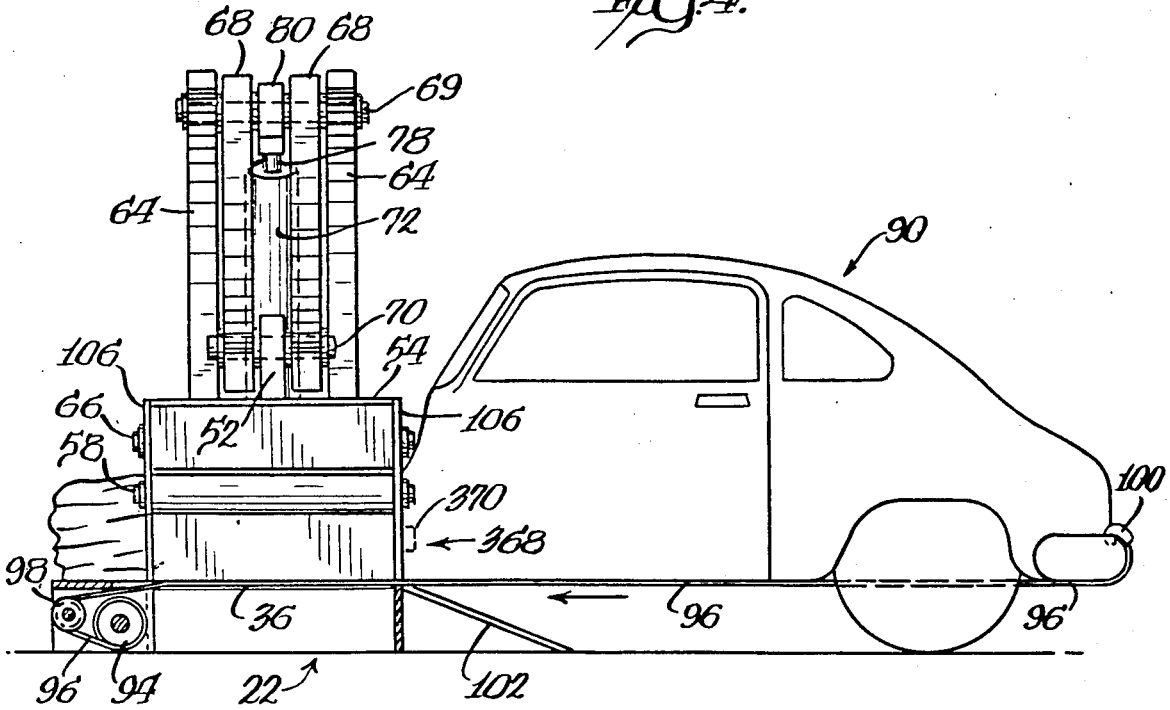
FIG. 4 is a section view of the car compactor taken along line 4—4 of FIG. 2 and illustrating the advancement and compaction of a car.

To advance a junk vehicle, shown generally as 90 in FIG. 4, a winch mechanism 92, including a driven spool 94, is provided. The winch mechanism 92 is frontally disposed on the flatbed 22 and, as shown in FIG. 1, is housed within a winch housing 82. The winch housing 82 has a pair of spaced supporting members 84 secured to the flatbed 22 and extending frontally therefrom. The members 84 are preferably of the same construction (i.e., tubular steel) as are the flatbed joists 24 to conserve weight and reduce cost. Attached to and spanning the upper edges of the members 84 is a winch cover plate 86. The cover plate 86 protectively covers the winch mechanism 92 and is co-planar to the plate 36 of the flatbed 22 thereby providing an overall flat surface. A rectangular way 88 is disposed at the edge of the cover plate 86 to register with the groove 38.

To advance the vehicle 90, a winch line 96 is payed out from the spool 94 for attachment to the rearmost end of the vehicle 90. The winch mechanism 92 is then manually or, as described below, automatically activated to retrieve the line 96 and pull the vehicle 90 from the rear, in effect pushing the vehicle, over the flatbed 22 for compaction by the doors. Since the winch mechanism 92 is mounted to the flatbed 22, the compactor 20 does not walk during the advancement of the vehicle over the flatbed 22. To enable the entire vehicle to be pulled through the compactor 20, the winch mechanism 92 includes a pulley 98 rotatably secured in the frontmost portion of the winch housing 82. From the spool 94 the line 96 passes around the pulley 98, from bottom to top, and thereafter extends outward through the way 88 and groove 38 for attachment to the vehicle 90.

To enable the vehicle 90 to smoothly enter the compactor 20 a ramp 102, which may be either hinged or removably secured to the flatbed 22, provides a smooth transition from the ground up to the compaction plate 56.

For the safety of the operator and for protection of the internal mechanical, hydraulic, and electrical gear, the ends of the flatbed 22 support upstanding end and side walls 104 and 106. As seen in FIG. 1, the end and side walls 104 and 106 enclose the regions dedicated to the pivoting of the hydraulic cylinder 71 and rear arms 64. Additionally the compactor 20 has secured to the flatbed 22 a housing 108 to provide a protective envelope for the electrical and hydraulic equipment described below and an operator cage 110 to protect the operator during compactor operation.

An alternate embodiment of the winch mechanism 92 is illustrated in FIG. 16, which allows the vehicle 90 (not shown) to be pulled by its front portion through the compacting area. As previously described above, the winch mechanism 92 is entirely and integrally connected to the front portion of the flatbed 22, except that the winch mechanism 92 is spaced a further distance from the joist 24. The winch housing 82 is secured to and spaced from the flatbed 22 by a pair of extension members 170 which connect to supporting members 84 and the joist 24 by engaging a first and second pair of slide rails 174 and 176, respectively. The extension members 170 are preferably of the same construction as the supporting members 84, i.e., tubular steel. The distance between the winch housing 82 and the joist 24 may be adjusted by inserting one or more pairs of additional lengths such as a pair of second extension members 172. An additional pair of slide rails 178 may then be used to connect the second pair extension members 172 to the first pair of extension members 170. The first and second pairs of extension members 170 and 172 still allow the use of the winch line 96 to extend over the flatbed 22 through the groove 38. When the vehicle is pulled by its front portion, use of the groove 38 is optional. The hook 100 is then used to attach to the front of the vehicle (not shown). The cover plate 86 (not shown) is still used to protectively cover the winch mechanism 92. The spacing between the winch mechanism 92 and the flatbed 22 is determined by the length of the car to be crushed such that the entire vehicle may be pulled by its front end through the crushing area (not shown) before the engagement hook 100 is drawn onto the winch mechanism 92.

Hydraulics

Figure 13:
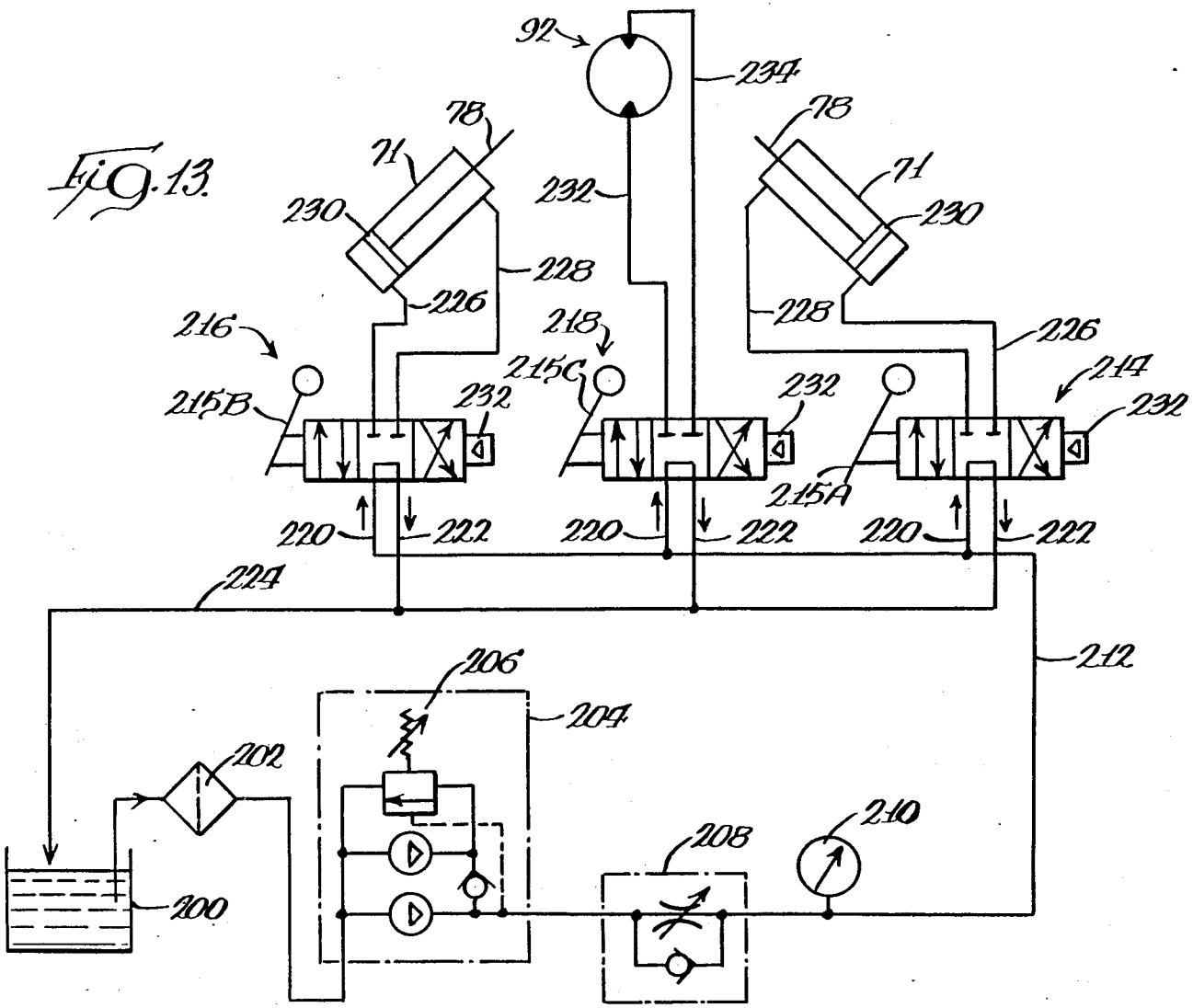
FIG. 13 is a schematic for the hydraulic control of the compactor.

Turning to FIG. 13, the hydraulic drives for the winch mechanism 92 and the hydraulic cylinders 71 is shown in detail. A vented reservoir 200 provides a constant supply of hydraulic fluid through a replaceable filter 202 to a dual-stage hydraulic pump 204, all of which are contained within the housing 108. The dual-stage hydraulic pump 204 has the capability of providing relatively high flows below a low pressure set point such as, for example, 800 psig and low flow at high pressures, such as 2400 psig. This enables hydraulic cylinder 71 to move quickly, due to relatively high flows, during, for example, opening and the initiation of compaction. However, when sufficient resistance is encountered, the hydraulic cylinders 71 move with greater force. The above results in faster operation without requiring separate hydraulic pumps. The hydraulic pump 204 is driven by a gasoline engine or, in the alternative, an electric motor (not shown). The automatic switching of the dual-stage hydraulic pump 204 from low pressure high flow to high pressure low flow can be set via an adjustable switching valve 206 which is auxiliary to the pump 204.

From the hydraulic pump 204 the fluid passes through an adjustable bypass valve 208 which is set at the upper limit of pressure desired in the system (the exemplary 2400 psig). The pressure output of the hydraulic pump 204 will switch from low pressure high flow to high pressure low flow at 800 psig and thereafter its output pressure will continue to rise until the set pressure of 2400 psig of the adjustable bypass valve 208 is achieved. Thereafter, flow will automatically be bypassed by bypass valve 208 to maintain the upstream pressure at 2400 psig. The pressure leaving the adjustable bypass valve 208 of the hydraulic fluid is monitored by a pressure gauge 210.

To provide the operating functions for the doors and the winch mechanism 92 the hydraulic fluid is supplied downstream of the adjustable bypass valve 208 to the hydraulic cylinders 71 and the winch mechanism 92 by a supply header 212. Interposed between the supply header 212 and the aforementioned hydraulic cylinders 71 and winch mechanism 92 are right and left door operating valves 214 and 216, respectively, and a winch operating valve 218. In that the operation of the right and left valves 214 and 216 are similar, only one will be described in detail.

The right valve 214 ports hydraulic fluid to and from the hydraulic cylinder 71 to drive the linkage 62 dedicated to the right door 40. Accordingly, a supply line 220 interconnects the right valve 214 to the supply header 212 and a return line 222 likewise interconnects the right valve 214 to a return header 224 for ultimate return to the reservoir 200. Interconnecting the right valve 214 to the hydraulic cylinder 71 are a pair of lines 226 and 228 which, as shown in the drawing, are connected to the hydraulic cylinder 71. Accordingly, depending upon how hydraulic fluid is ported to the hydraulic cylinder 71 by the right valve 214, a piston 230 having secured thereto the rod 78, as described above, will move to operate the linkage 62 for the opening and closing of the right door 40.

To advance the automobile 90 for compaction, the winch valve 218 selectively drives the winch mechanism 92. Similar to the right and left valves 214 and 216, the winch valve 218 selectively ports hydraulic fluid from supply line 220 to one of a pair of lines 232 or 234 depending upon whether the winch mechanism 92 is to wind or unwind line 96. The line not receiving fluid from line 220 is appropriately vented to the reservoir 200.

The right and left valves 214 and 216 and the winch valve 218 are controlled in the manner set forth below to operate the compactor 20 for compaction of the vehicle 90.

Compactor Control

The operations of the compactor 20 to advance a segment of the vehicle 90 over the flatbed, to close the doors for compaction of the vehicle, to raise the doors, and to advance another segment of the vehicle, may be either manually or automatically controlled by a sequence control circuit. Manual control can take the form of either individual control of each door and the winch mechanism. Alternately, the doors may, under manual control, be simultaneously operated by one control and the winch by another control. Under automatic control each operation of the compactor follows a timed sequence. Accordingly, manual operation and supervision of these functions can be eliminated.

One form of manual control includes three 3-position joysticks 215A–215C located in the operator's cage 110, each operatively connected to the right and left valves 214 and 216 and the winch valve 218 respectively. From a neutral first position, each 3-way joystick 215A and 215B may be moved by the operator to a second position whereupon the valves are disposed to port fluid to the hydraulic cylinders 71 to individually open the doors. Springs 232 normally bias each valve to the neutral position. In their third position the 3-way joysticks 215A and 215B cause fluid to be ported to the hydraulic cylinders 71 to close the doors individually. In a like manner, the 3-way joystick 215C may be moved from a neutral first position to a second position causing the winch mechanism 82 to pay out line 96 for connection to the vehicle 90. Moving the 3-way joystick 215C to its third position causes the winch mechanism 92 to wind line 96 and advance the vehicle 90 over the flatbed 22. The foregoing manual operation permits individual control of the compactor functions.

Figure 14A:
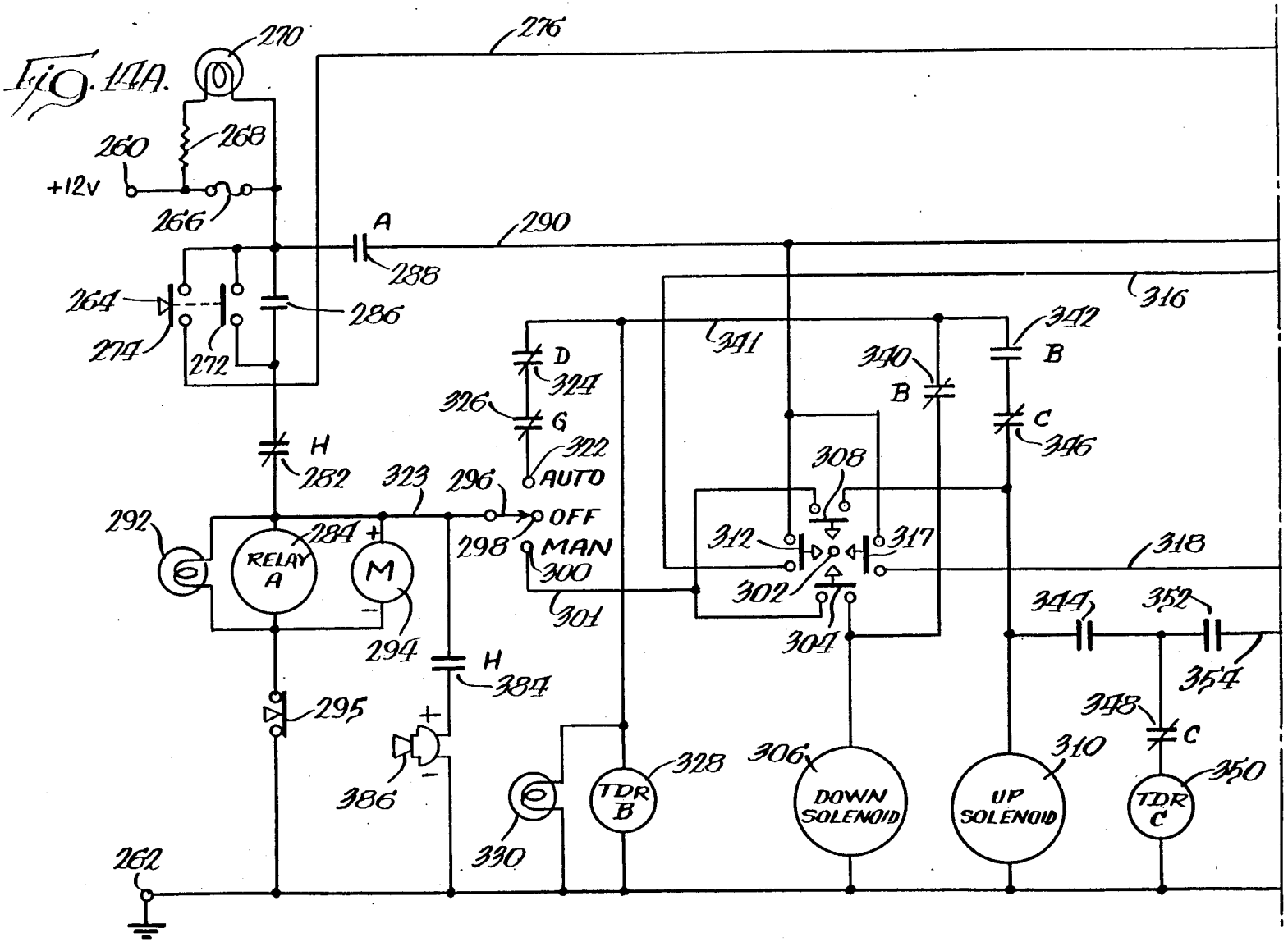
FIGS. 14A and 14B are a schematic of the electrical controls of the compactor.
Figure 14B:
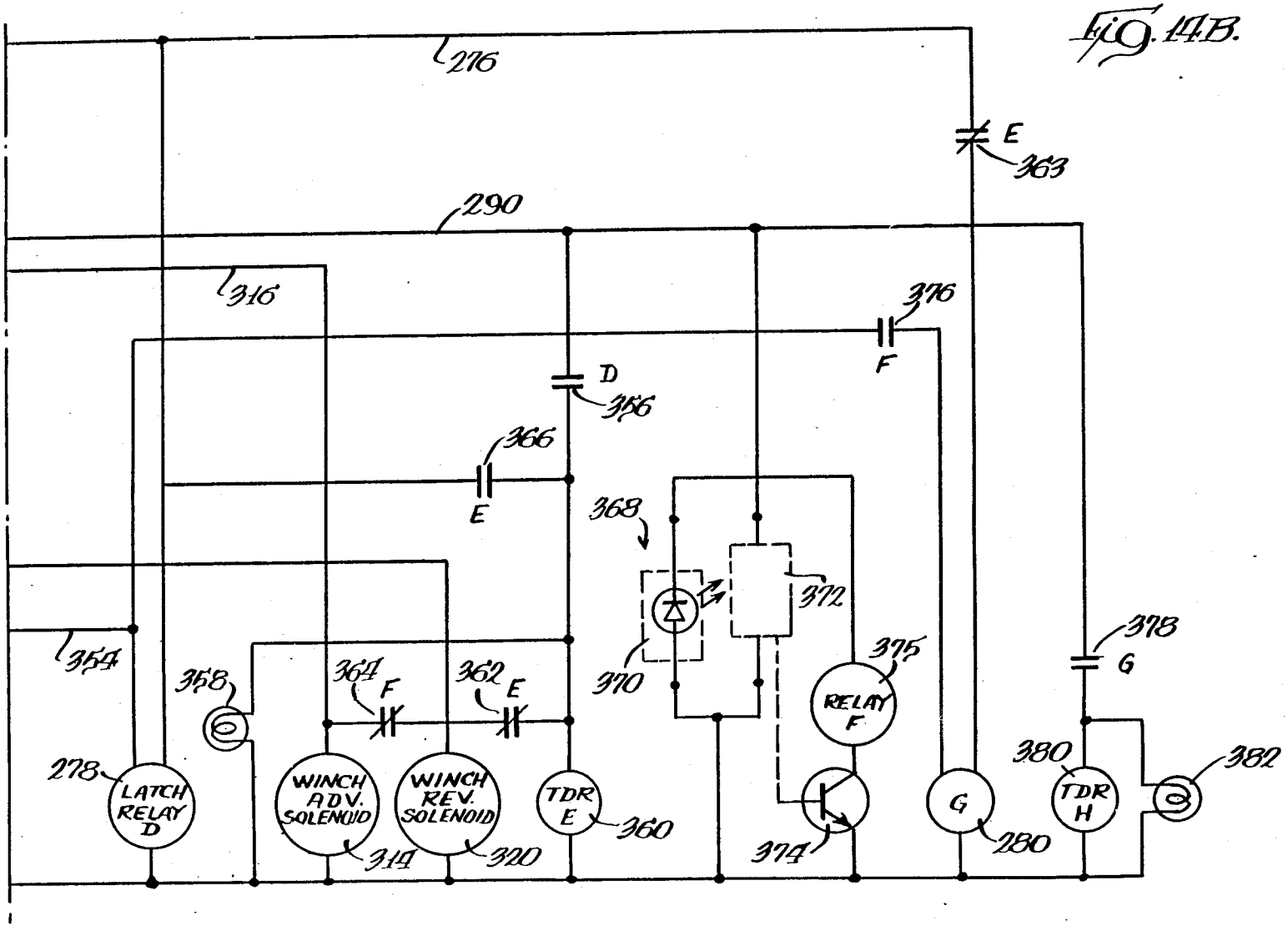

For normal operation, a manual and automatic sequence control circuit, shown in FIGS. 14A and 14B, is used to control the disposition of the valves 214, 216 and 218 to operate the compactor 20. The illustrated control circuit is powered by a +12 volt D.C. source connected across terminals 260 and 262, terminal 262 being connected to ground. The +12 volts is connected to a normally open start switch 264 through a fuse 266 across which is connected a resistor 268 in series with a light 260 to provide a blown fuse indication.

Operation of the compactor 20 is initiated by depressing the start switch 264 having a contact 272 and an early make contact 274. When actuated, the early make contact 274 provides a signal on a line 276 resetting a pair of latch relays D 278 and G 280 to insure that their respective contacts are in the normally open or normally closed positions at the initiation of the compactor operation. The start switch contact 272, when actuated, connects the +12 volt source through a normally closed relay H contact 282 to a relay A 284. The relay A 284, when energized, closes normally open relay A contacts 286 and 288, contact 286 maintaining the relay A energized after the start switch 264 is opened and contact 288 providing +12 volts on a line 290 to the control circuit. A power-on light 292 and a digital hour recording meter 294 are connected in parallel with the relay A and operate when the relay A is energized to provide a power-on indication and to record the hours of compactor operation. A stop switch 295 is connected between the relay A 284 and the ground terminal 262 to allow the entire circuit to be de-energized at any time.

A three position mode of operation switch 296 allows selection of either an automatic mode of operation or a manual mode of operation. In the manual mode, the selector switch 296 is moved from the off position 298 to a terminal 300 providing +12 volts on a line 301. A five position joystick 302, under manual control, directs the right and left compactor doors up and down simultaneously and also advances and reverses the winch. It is to be noted, however, that should the doors be overlapping as illustrated in FIG. 15D, the overlying door is slightly delayed during closing and the underlying door is slightly delayed during opening. This assures the proper overlapping of the doors.

To compact a vehicle 90 under this form of manual control, the five position joystick 302 shown in FIG. 14A is moved to a first position such that a joystick contact 317 connect the +12 volts on line 290 through a line 318 to a winch reverse solenoid 320. The solenoid 320 operates the winch valve 218 causing the winch mechanism 92 to pay out line 96 for attachment to the rearmost end of the vehicle 90. Thereafter the joystick 302 is moved to a second position such that a joystick contact 312 connects line 290 to a winch advance solenoid 314 through a line 316. The winch advance solenoid operates the winch valve 218 causing the winch mechanism 92 to wind line 96 thereby pulling a segment of the vehicle 90, from its rear, onto the flatbed 22.

To close the compactor doors for compaction of the vehicle segment, the joystick 302 is moved to a third position so that a contact 304 connects the +12 volts on the line 301 to a doors down solenoid 306 which operates the right and left valves 214 and 216 to simultaneously close the right and left compactor doors to the position substantially shown in FIG. 4. Again, it is to be noted that should the doors be overlapping, certain delays in the simultaneous opening and closure of the doors is required to assure proper overlapping during compaction.

To open the compactor doors, the joystick 302 is moved to a fourth position in which a contact 308 connects the +12 volts on the line 301 to a doors up solenoid 310 which simultaneously operates the hydraulic valves 214 and 216 to raise the right and left compactor doors. The fifth position of the joystick 302 represents a neutral position at the position the valves move to block flow to and from the hydraulic cylinders 71 and winch mechanism 92. The joystick 215 is preferably biased toward the neutral position and of a momentary latch type which provides incremental movement for the doors and the winch mechanism 92 in the manual mode.

For operation in the automatic mode, the selector switch 296, shown in FIG. 14A, is moved to a terminal 322 connecting the +12 volts on line 323 through a normally closed relay D contact 324 and a relay G contact 326 to a time delay relay B 328 across which is connected a compacting cycle indicator light 330. When power is initially applied, the time relay B 328 does not change the normal state of its contacts until after its associated time delay expires. During the time delay of the relay B 328, a relay B contact 340 remains in the normally closed position connecting the +12 volts on line 341 to the doors down solenoid 306 which operates the hydraulic valves 214 and 216 to close the right and left compactor doors simultaneously for compaction. Upon expiration of the time delay of relay B, the relay B contact 340 opens, and normally open relay B contacts 342 and 344 close. When closed, the relay B contact 342 connects the +12 volts on line 341 through a normally closed relay C contact 346 to actuate the doors up solenoid 310 and through relay B contacts 334 and a normally closed relay C contact 348 to a time delay relay C 350. The doors up solenoid 310 remains actuated operating the hydraulic valves 214 and 216 to open the right and left compactor doors simultaneously until the time delay associated with the relay C 350 expires. At the expiration of the time delay of relay C, the normally closed relay C contacts 346 and 348 open and normally open relay C contact 352 closes providing a set pulse on a line 354.

The pulse on line 354 sets the latch relay D 278, signalling the termination of the crush cycle with the compactor doors in a fully open position. In the set state, the latch relay D 278 opens normally closed relay D contacts 324 and closes a normally open relay D contact 356 initiating the winch advance cycle which is indicated by a light 358. During the winch advance cycle, the relay D contact 324, which is open, prevents the doors down solenoid 306 and the doors up solenoid 310 from being actuated by removing power from the line 341. The relay D contact 356 when closed, connects the +12 volts on the line 290 to a time delay relay E 360, powering the relay. During the time delay of the relay E 360, a normally closed relay E contact 362 remains closed connecting the +12 volts on line 290 through the closed relay D contact 356 and through a normally closed relay F contact 364 to the winch advance solenoid 314. When actuated the solenoid 314 operates the hydraulic valve 218 to advance the winch and the material to be compacted through the compactor a predetermined distance. For a time delay of relay E 360 of approximately five seconds, the material will be advanced through the compactor about thirty inches.

At the expiration of the time delay associated with the relay E 360, the relay E contact 362 opens terminating the actuation of the winch advance solenoid 314. At the same time a relay E contact 363 opens and a relay E contact 366 closes. The closed relay E contact 366 provides a path for a reset signal from the +12 volts on line 290 through the closed relay D contact 356 to the latch relay D 278 on line 276. The open relay E contact 363, at the completion of each winch advance cycle, prevents the reset signal on line 276 from being applied to a latch relay G 280 which, as will be described below, prevents the doors down and doors up solenoids from actuating after the termination of the last compacting cycle. The latch relay D 278, when reset by the signal applied through the closed relay E contact 366, closes the relay D contact 324 and opens the relay D contact 356. With the relay D contact 324 closed, the compacting cycle is again initiated such that the doors down solenoid 306 is actuated during the time delay of relay B 328 after which the doors up solenoid 310 is actuated during the time delay of relay C. After the expiration of the time delay of relay C, the winch advance cycle is again operative during the time delay of relay E 360.

The alternate operation of the compacting cycle and the winch advance cycle continues until during the winch advance cycle with the latch relay D 278 set, the end of the automobile is sensed by a photoelectric sensor 368. The sensor 368 is mounted on the sidewalls 106 of the compactor adjacent to the lead in ramp 102, the sensor having an emitter 370 secured to the left sidewall and a receiver 372 secured to the right sidewall as seen in FIG. 4 with only the emitter being shown. When the automobile has been advanced such that the end thereof is past the sensor 368, the light from the sensor emitter 370 hits the sensor's receiver 372 which provides current from the line 290 to the base of a transistor 374, turning the transistor on. With the transistor 374 turned on, current from the line 290 is drawn through a relay 375 to ground, actuating the relay F to close a normally open relay F contact 376 and to open the normally closed relay F contact 364. When the relay F contact 364 opens, actuation of the winch advance solenoid 314 is stopped. Subsequently, when the time delay of relay E 360 expires, the reset pulse will be provided to latch relay D 278 through the closed relay E contact 366 to that one last crush cycle will be performed, the reset pulse being prevented from actuating the relay G 280 on the last crush cycle due to the open relay E contact 363.

At the termination of the last compacting cycle, the pulse provided on line 354 sets the latch relay D 278; however, the winch will not be advanced because the relay F contact 364 is open. The set pulse is applied to the latch relay G 280 through the closed relay F contact 376 indicating that the compaction cycle is complete. When the latch relay G 280 is set, the normally closed relay G contact 326 opens, removing power from the line 341 to prevent the doors down and doors up solenoids 306 and 310 from being actuated. At the same time, a relay G contact 378 closes, powering a time delay relay H 380 and lighting a cycle over indicator 382. At the expiration of the time delay of relay H 380, a normally open relay H contact 384 closes to provide a cycle over indication by means of an alarm horn 386 and the normally closed relay H contact 282 opens removing power from the entire circuit.

Accordingly, the compactor 20 may be manually or automatically operated. Under automatic control the vehicle 90 is entirely compacted without the necessity of manual supervision. This frees the operator for other tasks thereby reducing the cost of compactor operation. Additionally, by providing the sensor 368 to sense the passage of last segment of the vehicle 90 into the compactor 20, the compactor automatically performs the last compaction cycle and notifies the operator that compaction is complete.

Transport of the Compactor

Figure 7:
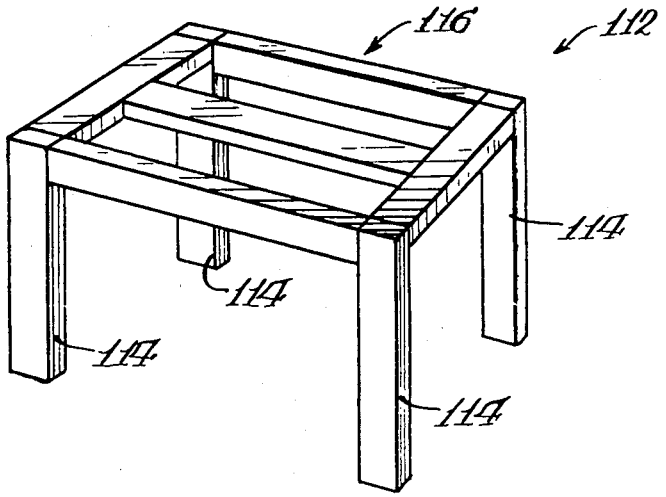
FIG. 7 is a perspective view of the table used to raise the compactor off the ground in order to facilitate its transport.
Figure 8:
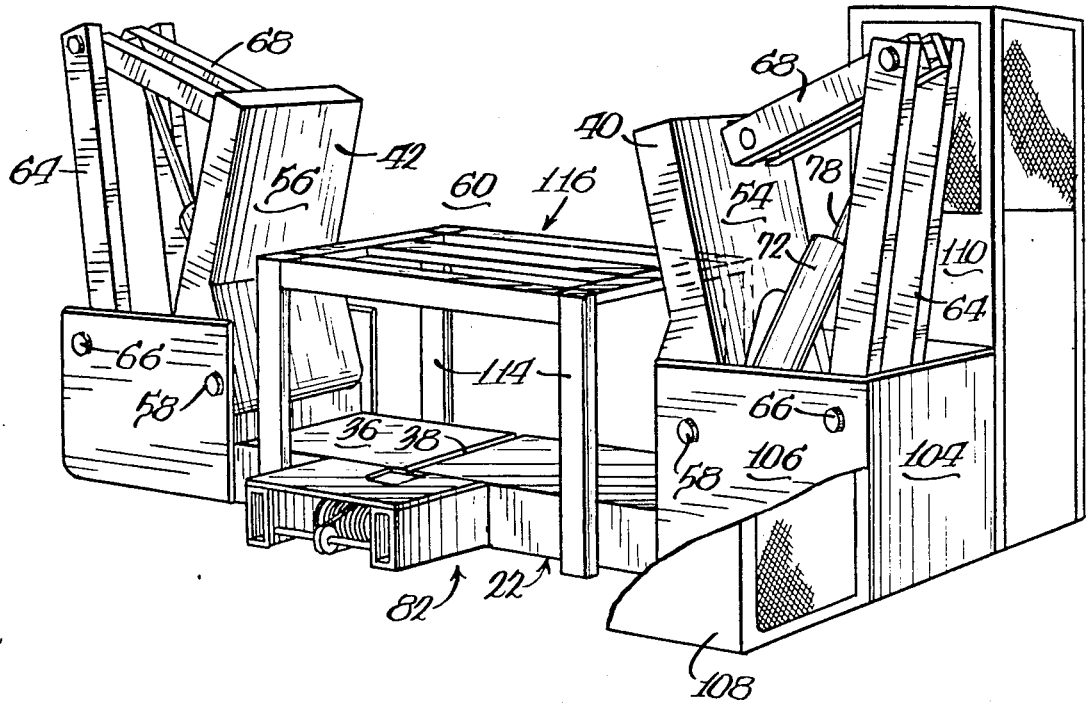
FIG. 8 is a perspective view of the compactor and table prior to the raising of the compactor off the ground.

To provide a means to easily transport the compactor 20, a frame table 112 as shown in FIG. 7 is provided, as is other auxiliary equipment hereinafter described. The table 112 has four upstanding legs 114 supporting and separated by a frame table top 116. As shown in FIGS. 8 and 9, the length, width and height of the table 112 should be such that the flatbed 22 is straddled by the legs 114 and the table top 116 is located for engagement by the doors 40 and 42.

Prior to transport, the doors 40 and 42 are opened and the table 112 is positioned therebetween as shown in FIG. 8. Manually actuating the doors 40 and 42 for compaction causes the table top 116 to be engaged thereby which, as the doors 40 and 42 continue downward, lifts the entire compactor 20 off the ground. When, as shown in FIG. 9, the compaction plates 56 of the doors 40 and 42 mate with the table top 116, the compactor 20 is fully lifted. To insure that no tipping of the compactor 20 occurs, the table top 116 should fully span the horizontal sections of the compaction plates 56 when the doors 40 and 42 are in the closed position.

While the interaction of the doors 40 and 42 and the table 112 maintain the compactor 20 in lifted position, wheels are mounted at one end to rollably support the compactor 20 above the ground. The wheels may be secured to the compactor 20 in such a manner as to lower when the compactor 20 is lifted or, as seen in FIGS. 9–12, a separate carriage assembly 118 may be provided which an operator rolls under the compactor and attaches to the frame. It is also contemplated within the scope of the invention that additional wheels and motive means could be provided so as to transform the compactor 20 into its own self-powered vehicle.

The carriage assembly includes a pair of wheels 120 rotatably disposed on the ends of an axle 122. A pair of leaf springs 124, one disposed near each wheel 120, interconnect the axle 122 with a pair of brackets 126 (only one shown in the drawings). Each bracket 126 has seat 128 defined by a horizontal brace 130 and upstanding retainer 132. The seats 128 closely receive the end of the compactor 20, which is pinned thereto by pins 134.

To support the end of the compactor 20 opposing the carriage assembly 118, and to provide a means for the haulage thereof, a C-shaped yoke 136 is secured thereto. The yoke 136 has at one end a pivot member 138 which is pivotally received into the bed of a tow vehicle 142 in a manner to permit the compactor 20 to be towed. At the opposing end, the yoke 136 has a standard 144 upon which the end of the compactor 20 rests. A pin passing through the yoke 136 and into the flatbed 22 maintains the engagement therebetween.

With the carriage assembly 118 and yoke 136 firmly secured to the compactor 20, the right and left doors 40 and 42 are hydraulically actuated to open, lowering the compactor 20 so that it is supported for towage by the carriage assembly 118 and, through the yoke 136, the bed 140 of the tow vehicle 142. Thereafter the table 112 is inverted and positioned such that the table top 117 rests against the plate 36. Lowering the right and left doors 40 and 42 which are spanned by the legs 114 maintains the table 112 in the stowed position during which the compactor 20 may freely be towed about.

While I have shown and described certain documents of a vehicle compactor, it is to be understood that it is subject to modification without departing from the invention described herein and set forth in the claims. For example, the timed sequence control may be modified such that advancement of the vehicle is determined by setting the control for a specific length of vehicle and the distance of advancement for each segment thereof. The control would accordingly advance the requisite number of segments for the given length of the vehicle thereby resulting in complete compaction thereof. In view of the foregoing, other modifications will be apparent to one skilled in the art.

We claim:

1. A device for compacting a vehicle, comprising:

a frame having a bed;

at least one compacting door disposed above said bed, said door movable toward and away from said bed;

drive means to drive each door toward and away from said bed for compaction of the vehicle; and a winch mechanism entirely and integrally connected to the frame to advance the vehicle over said bed in a direction from a rear portion of said bed towards a front portion of said bed for compaction by said door, said winch mechanism disposed adjacent said front portion of said bed and having a line connectable in a straight line between a front end of said vehicle and said winch so that retrieval of said line by said winch mechanism exerts force against said front of said vehicle to thereby advance the entire vehicle over said bed.

2. The device described in claim 1, wherein said winch mechanism includes a hydraulically driven winch which can be driven to pay out said winch line and retrieve said winch line to advance said vehicle over said bed.

3. The device described in claim 1, further including an automatic control system for actuating said drive means and winch mechanism, and sensor means responsive to the position of its vehicle for modifying the operation of the automatic control system.

4. The device described in claim 1, further including an automatic control system having means for actuating said drive means for opening and closing of said door during a compaction cycle mode of operation, said drive means opening said door at the termination of said compacting cycle, advance means for driving said winch mechanism at the termination of said compacting cycle for advancing the vehicle a distance over said bed, recycle means for reactuating said drive means for opening and closing of said door upon termination of the advance of the vehicle, sensor means for sensing the end of the vehicle being compacted, and means responsive to said sensor means for terminating the advancing drive of said winch mechanism.

5. The device described in claim 4, having a pair of opposing doors, each pivotally mounted above said bed, said doors pivotally movable to converge toward one another and toward the frame for compaction of the vehicle therebetween and to divergingly open away from said bed.

6. The device described in claim 5, wherein said automatic control activates said door drive means to open and close said doors simultaneously.

7. The device described in claim 1, wherein said device having a pair of opposing doors, each pivotally mounted above said bed, said doors pivotally movable to converge toward one another and toward said frame for compaction of the vehicle therebetween and to divergingly open away from said bed.

8. A device as described in claim 7, the end of one of said doors opposing its pivotal mount has at least one protruding finger and the end of said other door opposing its pivotal mount is formed to mate with said at least one finger when said doors are closing to interlace with said at least one finger and compact the vehicle.

9. The device as described in claim 8, wherein said finger protrudes beyond the centerline of said bed.

10. A device for compacting a vehicle, comprising:

a frame;

a pair of opposing doors, each pivotally mounted above said frame by a door pin, said doors pivotally movable about said door pins to converge toward said frame for compaction of the vehicle therebetween and to divergingly open away from said frame, the end of one of said doors opposing its pivot pin having at least one protruding finger and the end of said other door opposing its pivot pin is formed to mate with said at least one finger when said doors are closing to interlace with said at least one finger and compact the vehicle;

a pair of linkages spaced from said door pins, each linkage being interconnected between each door and said frame to manipulate said doors for opening and closing thereof; and drive means interconnected between each linkage and said door pin for the corresponding door to drive said linkage to open and close said door.

11. The device described in claim 10, wherein said at least one finger protrudes beyond the centerline of said bed.

12. The device described in claim 10, wherein said linkage consists of at least one rear and one forward arm pivotally connected by an elbow pin, said rear arm pivotally supported above said frame by an upstanding linkage support, and said forward arm being connected to said door.

13. The device described in claim 12, wherein said drive means are interconnected between said elbow pins and said door pins.

14. The device described in claim 13, wherein said drive means for each door includes a hydraulic cylinder pivotally supported by either said door pin or said elbow pin and having a hydraulic piston with a piston rod pivotally secured to the other of said door pin or said elbow pin with movement of the piston thereby manipulating said linkage for opening and closing of said door.

15. A method of compacting a vehicle having a length in a direction of movement of the vehicle during compaction comprising the steps of:

providing a compacting device with a frame having a bed with front and rear portions, a door movable toward and away from the bed and a winch mechanism entirely and integrally connected to said frame adjacent the front portion of said bed and having a line with a free end;

connecting the free end of said line to a front end of said vehicle;

actuating said winch to draw said line in a straight line and advance said vehicle from said rear portion toward said front portion of said bed; and moving said door toward said bed to effect compaction of said vehicle;

whereby the entire vehicle can be drawn over said bed with said spaced from said front portion of said bed by a distance about equal to the length of said vehicle.

* * * * *